US005507057A

United States Patent [19]

Diefendahl et al.

[11] Patent Number: 5,507,057

[45] Date of Patent: Apr. 16, 1996

[54] BRIDGE SECTION SHIFTING DRIVE FOR A BRIDGE LAYING APPARATUS

[75] Inventors: Wolfgang Diefendahl, Straelen; Detlef Van Krimpen, Duisburg, both of Germany

[73] Assignee: Krupp Fördertechnik GmbH, Duisburg, Germany

[21] Appl. No.: 377,395

[22] Filed: Jan. 24, 1995

[30] Foreign Application Priority Data

Jan. 24, 1994 [DE] Germany ..... 44 01 768.5

[51] Int. Cl.[6] ..... E01D 15/12

[52] U.S. Cl. ..... 14/2.4; 14/2.5; 192/85 R

[58] Field of Search ..... 14/2.4, 2.5, 77.1; 192/85 C, 85 V, 85 R, 67 R

[56] References Cited

U.S. PATENT DOCUMENTS 5,040,654 8/1991 Trommer ..... 192/67 R
5,329,652 7/1994 Wiedeck et al. ..... 14/2.5

FOREIGN PATENT DOCUMENTS 3517724 3/1986 Germany .
90/05216 5/1990 WIPO .

*Primary Examiner*—Stephen J. Novosad
*Assistant Examiner*—Pamela A. O'Connor
*Attorney, Agent, or Firm*—Spencer & Frank

[57] ABSTRACT

A bridge laying apparatus for longitudinally displacing a bridge section includes a pinion shaft; a pinion secured to the pinion shaft for moving with the pinion shaft as a unit; a bearing rotatably and axially slidably supporting the pinion shaft; and a hydraulic power cylinder unit. The power cylinder unit includes a cylinder coaxially surrounding the pinion shaft and defining a cylinder chamber; and a hollow piston axially slidably accommodated in the cylinder chamber and being axially driven by a pressure prevailing in the cylinder chamber. The hollow piston surrounds the pinion shaft. There is further provided a coupling arrangement connecting the hollow piston with the pinion shaft for axially displacing the pinion shaft and the pinion into an axially advanced and into an axially withdrawn position. In the axially advanced position the pinion is situated in a region where it is adapted to mesh with a rack of a bridge section and in the axially withdrawn position the pinion is situated at a clearance from such region.

6 Claims, 4 Drawing Sheets

BRIDGE SECTION SHIFTING DRIVE FOR A BRIDGE LAYING APPARATUS

CROSS REFERENCE TO RELATED APPLICATION

This application claims the priority of German Application No. P 44 01 768.5 filed Jan. 24, 1994, which is incorporated herein by reference.

BACKGROUND OF THE INVENTION

This invention relates to a driving device incorporated in a bridge laying apparatus and is of the type which has on either side a pinion which is designed to mesh with a rack mounted longitudinally along a bridge section to advance the bridge section as the pinion is rotated. Each pinion may be moved axially by a hydraulic power cylinder unit into and out of the zone of the rack.

In published International Application WO 90/05216 a bridge laying vehicle is disclosed which has a laying arm designated as a laying device and a receiving device associated with the laying device. The laying arm as well as the receiving device are provided with a driving device which is adapted to shift individual bridge sections or a plurality of interconnected bridge sections on the laying-arm and/or the receiving device. The driving devices have on either side rack-driving pinions which mesh with racks which, as a rule, are arranged along the guide rails at the lower chord of the bridge sections.

In handling bridge sections the driving devices provided with the rack-driving pinions must perform three functions:

- they have to drive at least one bridge section in the longitudinal direction;
- they have to immobilize at least one bridge section on the laying apparatus; and
- they have to be releasable from all bridge sections to make possible a feed of interconnected bridge sections by the respective other drive or to make possible a lowering of a bridge section past the driving device without a collision between the rack of the bridge section and the pinion of the driving device.

For releasing the connection between the drive and the rack of the respective bridge section, German Offenlegungsschrift (application published without examination) 35 17 724 discloses an axially displaceably supported driving pinion intended to mesh with the rack, and the axial position of the pinion may be changed by a hydraulic cylinder arranged offset relative to the rotary axis. It is a disadvantage of such a solution that because of the eccentric arrangement of the hydraulic cylinder stresses and misalignments within the pinion guide box may occur and, as a result, the various functions may be adversely affected to a substantial extent.

SUMMARY OF THE INVENTION

It is an object of the invention to provide a driving device of the above-outlined type which makes possible a stress-free displacement of the rack-driving pinion.

This object and others to become apparent as the specification progresses, are accomplished by the invention, according to which, briefly stated, the bridge laying apparatus for longitudinally displacing a bridge section includes a pinion shaft; a pinion secured to the pinion shaft for moving with the pinion shaft as a unit; a bearing rotatably and axially slidably supporting the pinion shaft; and a hydraulic power cylinder unit. The power cylinder unit includes a cylinder coaxially surrounding the pinion shaft and defining a cylinder chamber; and a hollow piston axially slidably accommodated in the cylinder chamber and being axially driven by a pressure prevailing in the cylinder chamber. The hollow piston surrounds the pinion shaft. There is further provided a coupling arrangement connecting the hollow piston with the pinion shaft for axially displacing the pinion shaft and the pinion into an axially advanced and into an axially withdrawn position. In the axially advanced position the pinion is situated in a region where it is adapted to mesh with a rack of a bridge section and in the axially withdrawn position the pinion is situated at a clearance from such region.

According to an advantageous feature of the invention, the cylinder housing of the hydraulic power cylinder unit (piston/cylinder unit) is situated externally, about the bearing housing in which the rack-driving pinion is supported. The axially effective form-fitting and/or frictional connection between the piston/cylinder unit and the pinion is made as a flange connection of the free end of the hollow piston rod of the piston/cylinder unit and a bearing sleeve which is axially guided in the bearing housing and which supports the shaft of the pinion. For monitoring and controlling the horizontal or axial displacements of the pinion, two proximity switches responding to the end positions of the pinion are provided. The limit switches cooperate with an element, such as a pin, extending outwardly from the free end of the hollow piston rod.

To make possible an evaluation and control of the pinion-caused displacement of the bridge section on the laying device, the pinion shaft is connected with an angular position sensor whose signals, as determined by the structural features, may represent the displacement path of the bridge sections. According to a preferred embodiment of the invention, the pinion shaft is provided with outer teeth which are connected with the measuring shaft of the rotary position sensor by means of an intermediate gear.

DESCRIPTION OF THE PREFERRED EMBODIMENT

Figure 1:
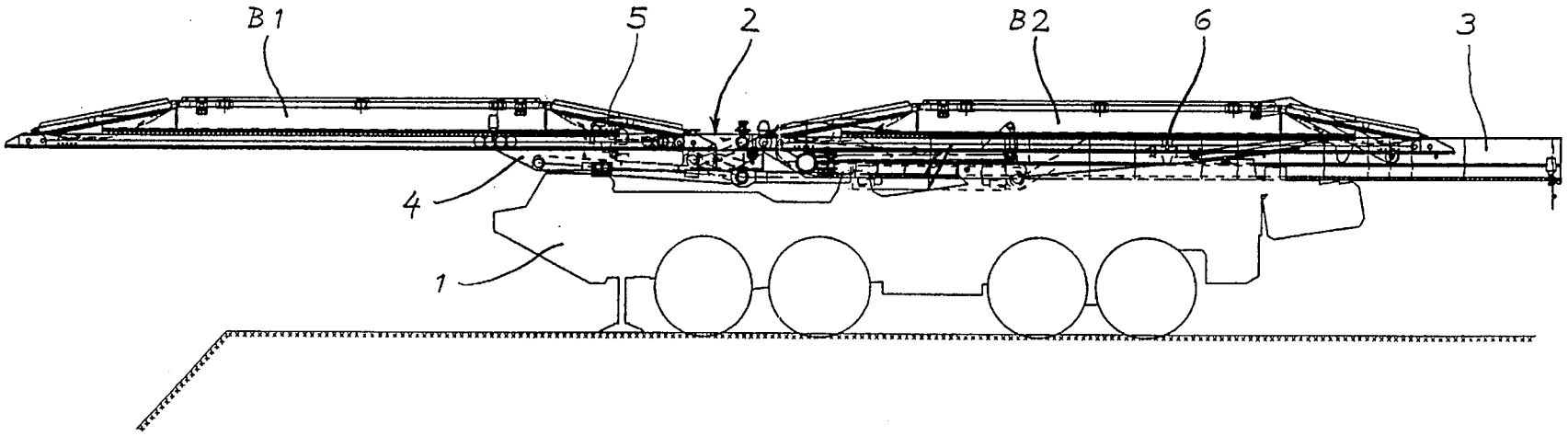
FIG. 1 is a schematic side elevational view of a bridge laying vehicle carrying a bridge laying apparatus which incorporates the invention and on which two bridge sections are position.
Figure 2:
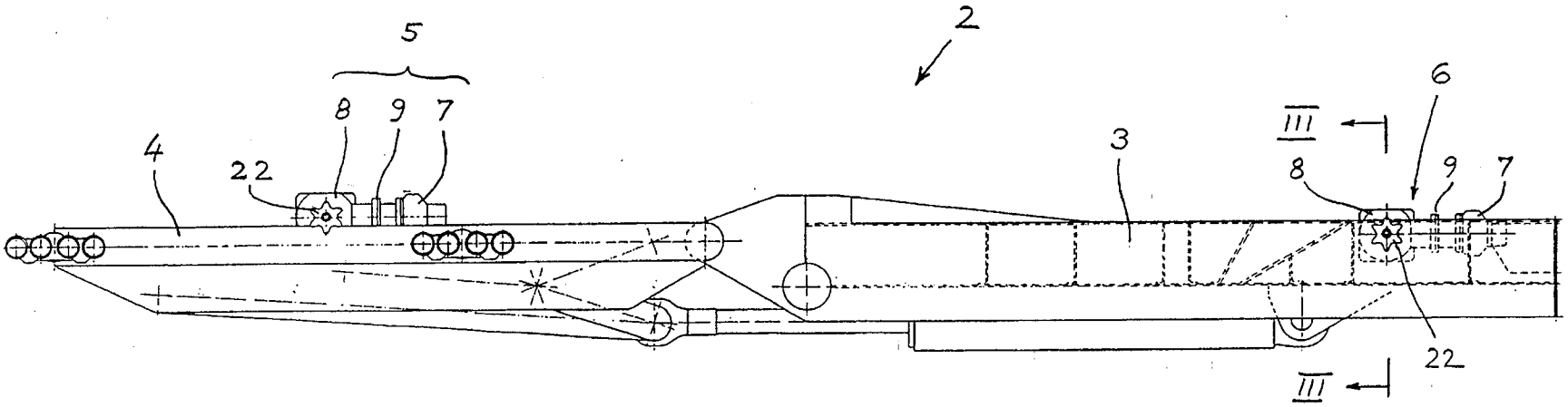
FIG. 2 is a side elevational view of the bridge laying apparatus incorporating the invention.

The vehicle 1 illustrated in FIG. 1 is provided with a bridge laying or launching apparatus 2 which is essentially formed of a shifter frame 3 and a laying arm 4 articulated thereto. The laying arm 4 as well as the shifter frame 3 are each provided with a respective driving device 5 and 6 for the bridge sections B1 and B2. Also referring to FIG. 2, the drives 5 and 6 are of identical construction; each has a hydro-motor 7, a gearing 8 and a hydraulically operable brake 9 arranged therebetween.

Figure 3:
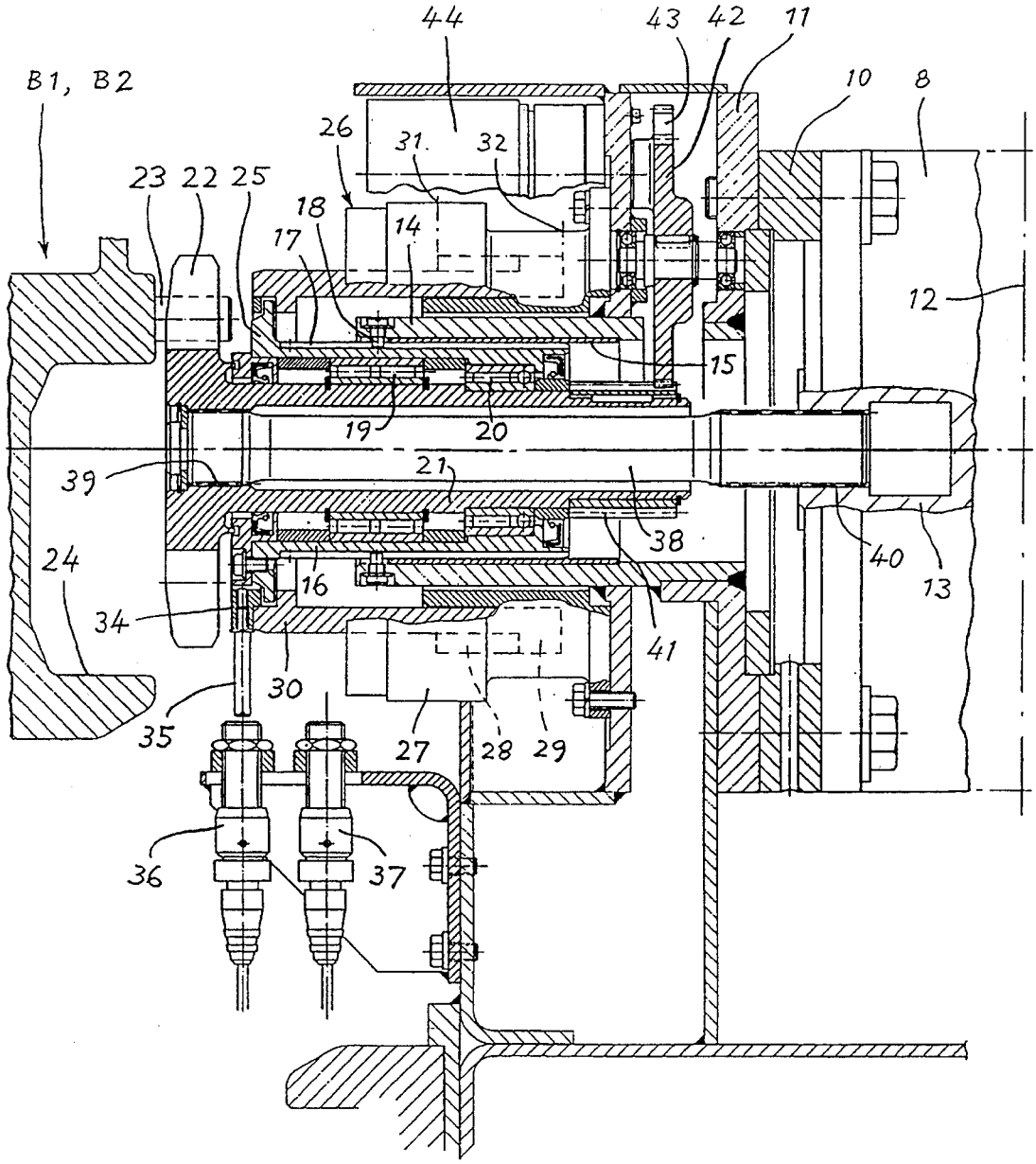
FIG. 3 is an enlarged detailed sectional view taken along line III—III of FIG. 2.

Also referring to FIG. 3, the gearing 8 is secured to the carrier structure 11 of the laying arm 4 by fittings 10. The gearing 8 is a T-shaped angular gearing and has on either side of its central plane 12 a driving hub 13 provided with a spline bore. It is noted that FIG. 3 shows only one side (that is, to the left of the center plane 12) of an otherwise substantially symmetrical construction.

The carrier structure 11 has on both sides a support housing or guide tube 14 provided on its inner face with a guide sleeve (or slide sleeve) 15. In the housing 14 a bearing sleeve 16 is supported which on its outer face has longitudinal, axially extending grooves 17 into which project radially inwardly oriented pins 18 secured to the support housing 14. The pins 18 ensure that the bearing sleeve 16 is prevented from rotating during its axial displacement. Inside the bearing sleeve 16 a hollow pinion shaft 21 is supported by a radial bearing 19 and a radial/axial bearing 20. To the outer end of the pinion shaft 21 a rack driving pinion 22 (hereafter only briefly referred to as pinion) is secured. The pinion 22 is to be brought into and out of a meshing engagement with rack pins 23—only one is visible in FIG. 3—of a rack mounted along the guide rails 24 of the bridge sections B1, B2. The bearing sleeve 16 has a flange 25 at its outer end, adjacent the pinion 22.

Figure 4:
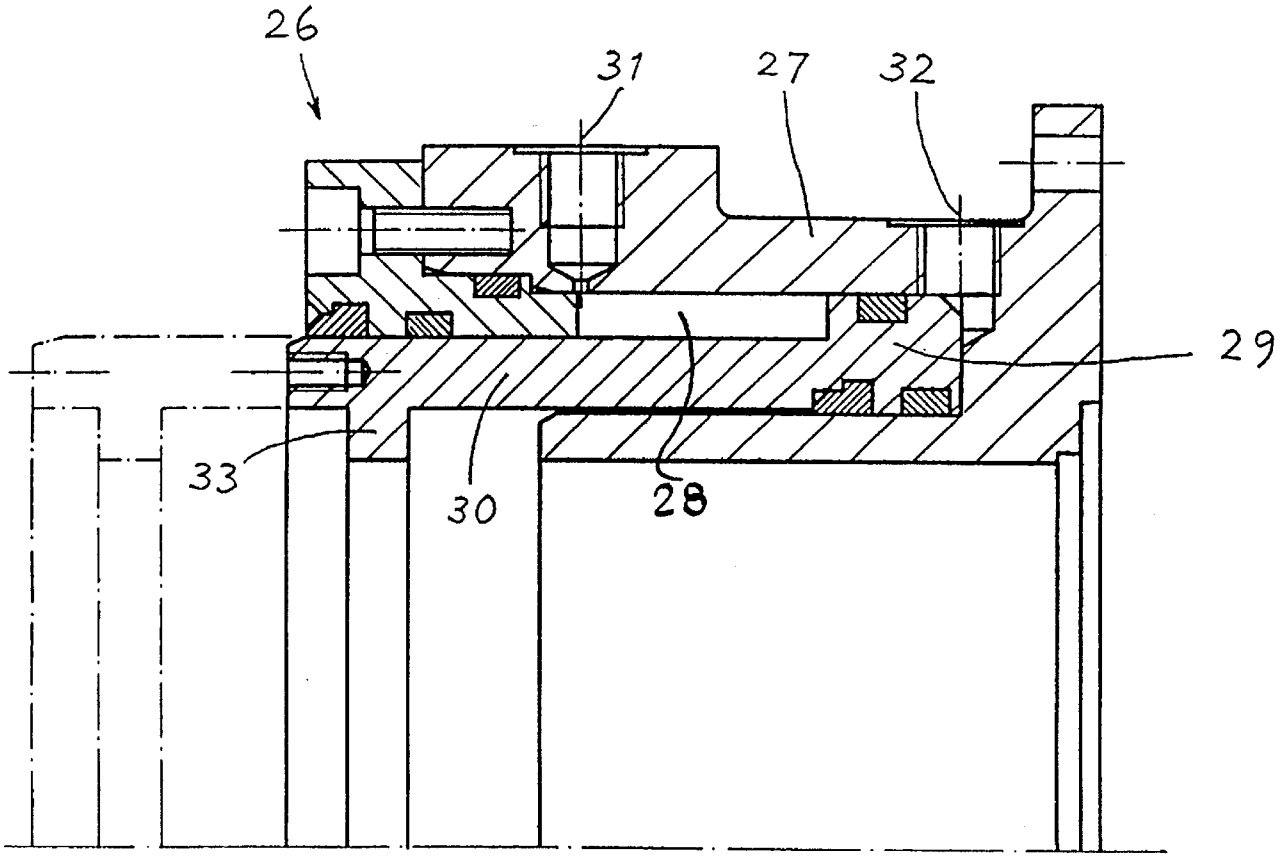
FIG. 4is an enlarged sectional front elevational view of a component of FIG. 3.

Also referring to FIG. 4, a hydraulic power cylinder unit (piston/cylinder unit) 26 surrounds the support housing 14; the unit 16 has a cylinder 27 which is fixedly bolted to the respective carrier construction 11. Within the annular cylinder chamber 28 of the cylinder 27 a hollow, annular piston 29 is slidably guided by means of a hollow, cylindrical, tubular piston rod 30. The cylinder 27 has at the axial ends of the cylinder chamber 28 inlets 31 and 32 for the intake and outlet of a pressure medium. At its outer end the hollow piston rod 30 has a radially inwardly oriented flange 33 whose inner diameter is less than the outer diameter of the flange 25 of the bearing sleeve 16, so that the piston rod 30 presses the bearing sleeve 16 and thus the pinion 22 in the direction of the pins 23 of the rack upon outward movement of the piston 29 (which is effected by introducing pressurized hydraulic medium at inlet 32behind the piston 29).

Reverting to FIG. 3, to that end of the piston rod 30 which is remote from the piston 29 a ring 34is secured which is cross-sectionally reduced in the region of the rack pins 23. The inner diameter of the ring 34is less than the outer diameter of the flange 25 of the bearing sleeve 16, so that the piston rod 30, upon retraction of the piston 29 carries with it the bearing sleeve 16 and thus the pinion 22 from the region of the rack pins 23.

A radially projecting actuator bar 35 is threaded into the ring 34 in a region thereof which is remote from the rack pins 23. In both terminal positions of the free end of the actuator bar 35 respective proximity switches 36 and 37 are arranged which operate as limit switches and with the aid of which an unequivocal indication of the respective end positions of the pinion 22 and thus a state of engagement of the pinion 22 with the rack pins 23 or a state of disengagement of the pinion 22 from the pins 23 may be securely determined.

A drive shaft 38 is accommodated inside the hollow pinion shaft 21 and extends coaxially therewith. The drive shaft 38 is torque-transmittingly coupled to the pinion 22 by means of a splined shaft/splined hub connection 39. At its other end the drive shaft 38 is torque-transmittingly connected with the respective drive hub 13 of the gearing 8 by means of a further splined shaft/splined hub connection 40.

That end of the hollow pinion shaft 21 which is remote from the pinion 22 is provided with outer teeth 41. An intermediate toothed gear 42supported by the carrier structure 11 connects the outer teeth 41 with the pinion 43 supported on the measuring shaft of an angular position indicator 44 mounted on the carrier structure 11. In this manner, in addition to the axial end positions of the pinion 22 sensed by the limit switches 36, 37, the number of revolutions of the pinion 22, and thus the displacement path of the bridge sections B1 and B2, effected by the rotation of the pinion 22, may be determined.

It will be understood that the above description of the present invention is susceptible to various modifications, changes and adaptations, and the same are intended to be comprehended within the meaning and range of equivalents of the appended claims.

What is claimed is:

1. A bridge laying apparatus for longitudinally displacing a bridge section having a longitudinally extending rack; the apparatus comprising (a) a pinion shaft;

(b) a pinion secured to the pinion shaft for moving with said pinion shaft as a unit;

(c) bearing means for rotatably and axially slidably supporting said pinion shaft;

(d) a hydraulic power cylinder unit including (1) a cylinder coaxially surrounding said pinion shaft and defining a cylinder chamber;

(2) means for pressurizing and depressurizing said cylinder chamber; and (3) a hollow piston axially slidably accommodated in said cylinder chamber and being axially driven by a pressure prevailing in said cylinder chamber;

(e) coupling means connecting said hollow piston with said pinion shaft for axially displacing said pinion shaft and said pinion into an axially advanced and into an axially withdrawn position; in said axially advanced position said pinion is situated in a region where it is adapted to mesh with a rack of a bridge section and in said axially withdrawn position said pinion is situated at a clearance from said region.

2. The bridge laying apparatus as defined in claim 1, wherein said bearing means includes a housing;said hydraulic power cylinder unit being disposed about said housing.

3. The bridge laying apparatus as defined in claim 2, wherein said hydraulic power cylinder unit includes a hollow piston rod affixed to said hollow piston in axial alignment therewith; further wherein said bearing means comprises a bearing sleeve coaxially surrounding said pinion shaft and axially slidably guided in and by said housing; said bearing sleeve relatively rotatably supporting said pinion shaft and being secured to said hollow piston rod for axially moving therewith as a unit; and said coupling means including means for axially force-transmittingly connecting said bearing sleeve with said pinion shaft.

4. The bridge laying apparatus as defined in claim 3, further comprising first and second stationarily supported proximity switches spaced parallel with a direction of axial displacement of said pinion shaft;and an actuator member affixed to said hollow piston rod for cooperating with said proximity switches such that the first proximity switch responds when said pinion shaft attains said advanced position and the second proximity switch responds when said pinion shaft attains said withdrawn position.

5. The bridge laying apparatus as defined in claim 1, further comprising an angular displacement indicating means for responding to and emitting a signal representative of, an angular position of said pinion shaft.

6. The bridge laying apparatus as defined in claim 5, wherein said angular displacement indicating means includes a toothed gear and said pinion shaft includes circumferentially arranged external teeth; further comprising an intermediate toothed gear meshing with said external teeth and said toothed gear of said angular displacement indicating means.

* * * * *